US006616542B1

(12) United States Patent
Reddick

(10) Patent No.: US 6,616,542 B1
(45) Date of Patent: Sep. 9, 2003

(54) ARTIFICIAL PUTTING SYSTEM

(75) Inventor: Randolph S. Reddick, Calhoun, GA (US)

(73) Assignee: U.S. Greentech, Inc., Calhoun, GA (US)

( * ) Notice: Subject to any disclaimer, the term of this patent is extended or adjusted under 35 U.S.C. 154(b) by 0 days.

(21) Appl. No.: 09/939,874

(22) Filed: Aug. 27, 2001

(51) Int. Cl.[7] ..... A63B 69/36
(52) U.S. Cl. ..... 473/171; 472/92; 428/17
(58) Field of Search ..... 473/171, 278, 473/157–162, 175; 428/17, 95; 472/92

(56) References Cited

U.S. PATENT DOCUMENTS

| | | | | | |
|---|---|---|---|---|---|
| 2,515,847 | A | * | 7/1950 | Winkler | 273/DIG. 13 |
| 3,399,899 | A | * | 9/1968 | Shepherd | 273/127 R |
| 3,407,714 | A | * | 10/1968 | Henderson | 428/17 |
| 3,418,897 | A | * | 12/1968 | Humalaninen | 428/17 |
| 3,664,241 | A | | 5/1972 | Blackburn | |
| 3,740,303 | A | * | 6/1973 | Alserson et al. | 404/31 |
| 3,802,790 | A | * | 4/1974 | Blackburn | 264/31 |
| 3,880,432 | A | * | 4/1975 | Coffey et al. | 428/17 |
| 3,995,079 | A | * | 11/1976 | Haas, Jr. | 428/17 |
| 4,067,757 | A | * | 1/1978 | Layman | 156/216 |
| 4,268,551 | A | | 5/1981 | Moore, Jr. | |
| 4,497,853 | A | | 2/1985 | Tomarin | |
| 5,250,340 | A | | 10/1993 | Bohnhoff | |
| 5,390,926 | A | | 2/1995 | Hanson et al. | |
| 5,460,867 | A | * | 10/1995 | Magnuson et al. | 405/36 |
| 5,908,673 | A | | 6/1999 | Muhlberger | |
| 5,916,034 | A | * | 6/1999 | Lancia | 473/157 |
| 6,221,445 | B1 | * | 4/2001 | Jones | 405/36 |

FOREIGN PATENT DOCUMENTS

| | | | | |
|---|---|---|---|---|
| DE | 109065 | * | 5/1984 | 273/176 J |

OTHER PUBLICATIONS

Turf Master, Advertisement Jan. 1, 1999, 6 pages.*

* cited by examiner

*Primary Examiner*—Mark S. Graham
(74) *Attorney, Agent, or Firm*—McNair Law Firm, P.A.

(57) ABSTRACT

A stable artificial putting green which includes a base, an intermediate layer, an artificial putting surface including a pile fabric supported by the intermediate layer, and an edging defining its outer limits. The pile fabric extends over the upper edge and down an outer side of the edging where it is secured. Fine sand fills the interstices about the pile yarns. The intermediate layer includes a PYRACELL layer. The PYRACELL layer includes a synthetic sheet formed with a plurality of raised conically shaped hollow cells over its upper surface. A plurality of drainage holes are formed in spaces between the cells and a non-wove porous web is secured to the lower surface of the sheet. Finally, a coarse sand is laid over the sheet up to substantially top surfaces of the cells.

19 Claims, 4 Drawing Sheets

Fig. 1
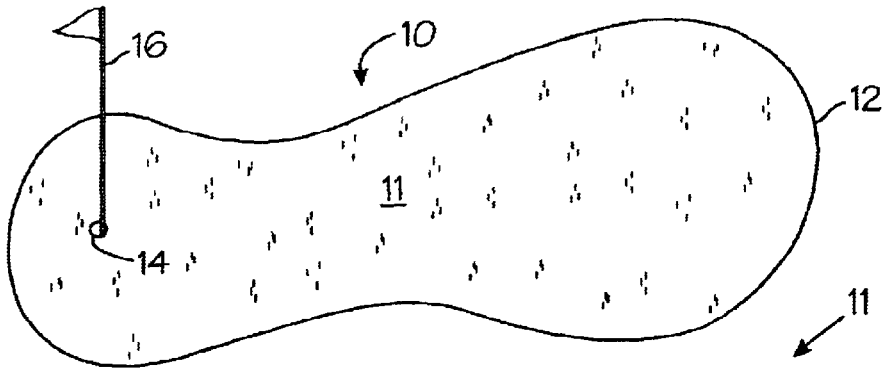
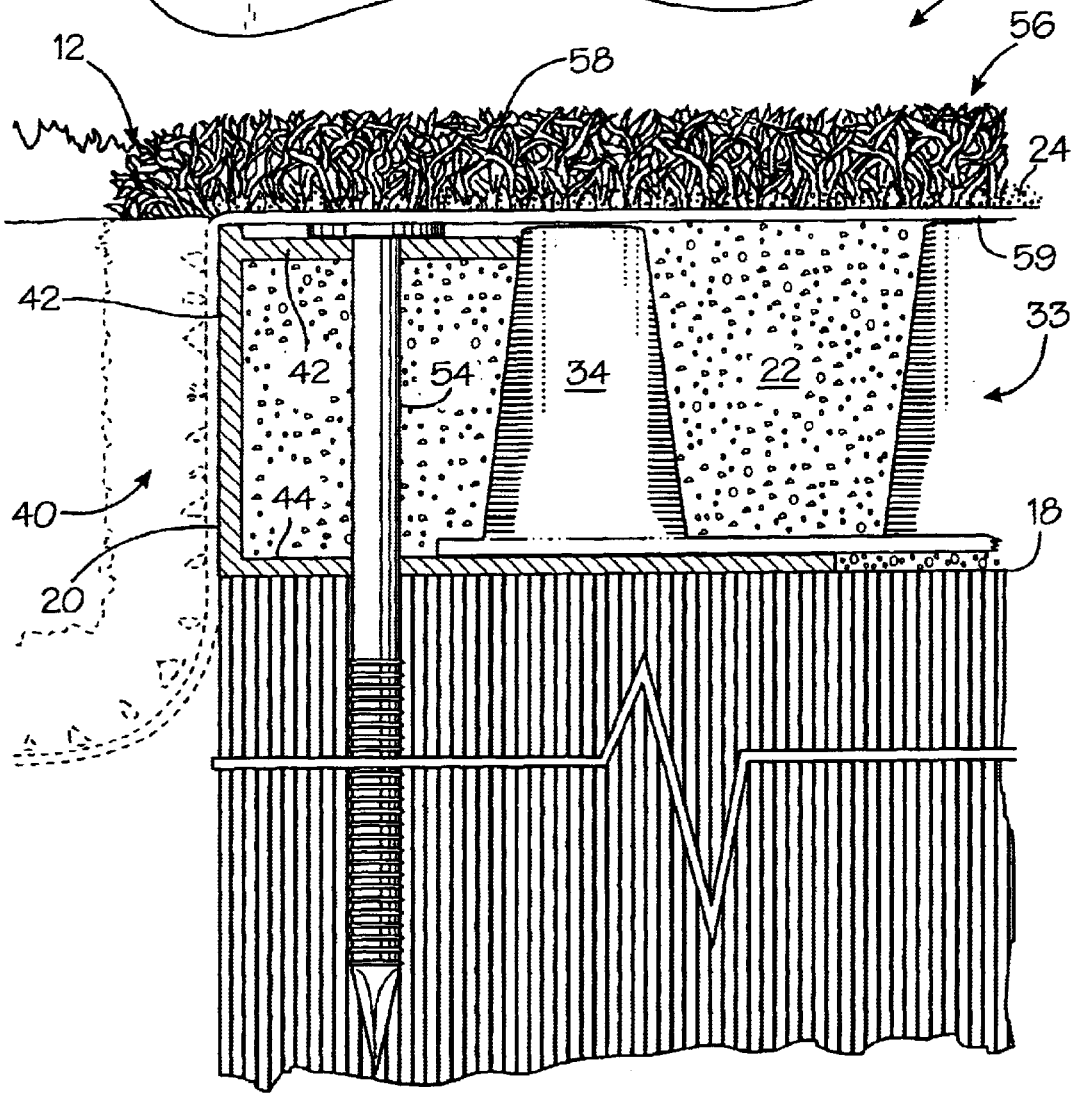
Fig. 2

ARTIFICIAL PUTTING SYSTEM

This invention is related to co-pending application Ser. No. 09/902,142, filed Jul. 10, 2001.

BACKGROUND OF THE INVENTION

This invention is directed to an artificial putting green.

Artificial putting greens are well known as illustrated by the U.S. Pat. No. 3,740,303 to Alderson et al.; U.S. Pat. No. 4,497,853 and No. 5,916,034. These constructions, as is typical with other known constructions, are either very expensive to construct or maintain or do not provide realistic ball reception and roll qualities.

It is therefore an object of this invention is to provide an artificial putting green which is easily constructed.

Another object of the present invention is an artificial putting green which provides feel or ball roll resistance substantially duplicating that of a natural putting green.

Another object of the present invention is an artificial putting green of defined area.

Another object of the invention is an artificial putting green with border members.

Another object of the invention is an artificial putting green with adequate resilience to depress sufficiently to receive incoming golf balls and sufficient recovery to rebound and provide a smooth putting surface.

Another object of the invention is an artificial putting green with infrastructure to remove sharp variations occurring randomly over the ground surface.

Another object of the invention is an artificial sports playing surface with infrastructure to remove sharp variations over the ground surface providing a smooth even playing surface.

SUMMARY OF THE INVENTION

The instant invention is directed to an artificial putting green of a defined area formed to include a base, an intermediate layer extending over and supported by the base, an artificial putting surface including a pile fabric supported by the intermediate layer, and an edging arranged about the defined area. The pile fabric is arranged to extend over the upper edge and down the outer side of the edging where it is secured.

The edging comprises a plurality of pieces interconnected with elongated securing members forming pivotal connections. The edging pieces include a vertical panel with a plurality of upper and lower superimposed horizontal shelves extending from a first side thereof. Each edging piece is more than two feet in length while each upper and lower shelf is about five inches in length and is separated from adjacent of the upper and lower shelves by a gap of about one half inch which forms a flex point. Each pair of the superimposed horizontal shelves receives an elongated securing member which further secures the pieces in desired positions.

The artificial putting green includes a golf cup retaining tube which is embedded in the base. A golf cup is carried in the retaining tube. The pile fabric which is cut to form flaps which pass over an upper edge of the retaining tube and extend into the retaining tube to a position between an inner surface of the retaining tube and an outer surface of the golf cup. The retaining tube and golf cup here act to grip the flaps holding the pile fabric in position.

An artificial sport playing surface of a defined area having improved stability and feel which includes a base and an intermediate layer positioned over the base.

The intermediate layer comprises a PYRACELL layer covering the base. The PYRACELL layer includes a synthetic sheet formed with a plurality of raised conically shaped hollow cells over its upper surface arranged in equally spaced positions. A plurality of drainage holes are formed in between certain of the cells and a non-woven porous web is secured to the lower surface of the sheet. The web covers the open ends of the cells which maintains them clear while at the same time allows drainage through the holes. A coarse sand is applied over the upper surface of the sheet at least substantially up to the top surface of the cells. The artificial sport playing surface supported by the intermediate layer. The course sand may also be applied over the base at fill in selected areas.

The artificial sport playing surface includes a pile fabric with pile in the range of ¾" to 1½" in height and fine sand filling the areas between and about the pile up to a point about ⅛" to 3/16" below the pile tips.

The sport playing surface when used as a putting green provides a surface with adequate resilience which also compresses sufficiently to accept a golf shot, but returns quickly to its original position presenting a smooth uniform surface providing adequate feel.

The cells are arranged along X and Y axes in parallel rows with adjacent cells being spaced by about 1–¼". The cells are conical shaped decreasing in diameter by about ½" from bottom and top.

The coarse sand is mortar grade sand which fills the area between the cells to a height which is substantially equal the height of the top surfaces of the cells.

An edging encircles the defined area. The edging is secured with the base by spikes located at spaced intervals about the defined area.

Each edging piece includes a plurality of upper shelves and lower shelves, which are vertically spaced by about 1" and are longitudinally spaced by about 1–¼". The longitudinal spacings form flex points which allow the edging to be bent or flexed so that it conforms with the shape of the defined area.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a diagrammatic view of an artificial putting green of defined area;

FIG. 2 is a side sectional view of an edge position of the putting green of FIG. 1;

DESCRIPTION OF A PREFERRED EMBODIMENT

Figure 2A:
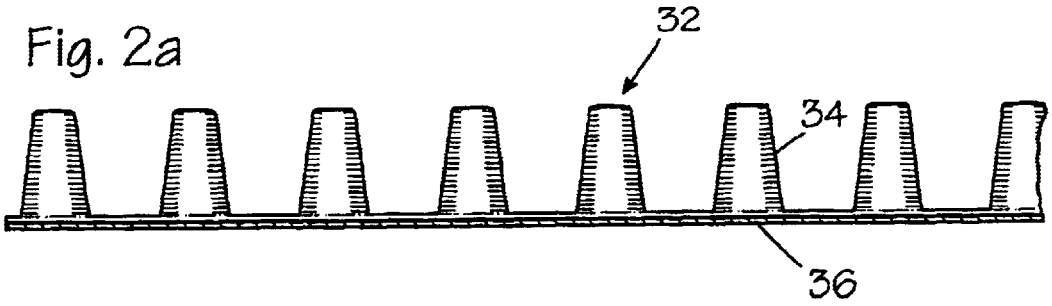
FIG. 2*a* is a sectional side view of a PYRACELL strip.

Referring now in more detail to the drawings, the invention will now be described in more detail.

Turning now to FIG. 1, an artificial putting green 10 of defined area and selected shape is depicted. The green includes putting surface 11, border 12, hole 14 and flag 16.

Artificial green 10 is generally constructed in three stages. First the area for the green is located and the base is formed. This is accomplished by removing the upper layer of sod and soil down to a depth of about 1½" to 2". The surface of the base is smoothed by dragging and packing to remove most sharp variations in the surface. It may be desirable to apply a thin layer of a course grade of sand. The depth of this sand layer is variable depending on the topography of the base surface.

The various components necessary for producing the artificial putting green of the invention are, of course, course sand 22, fine sand 24, PYRACELL strips 32, synthetic pile fabric or artificial turf 28 and edging pieces 20. Preferably the course sand is cement grade sand while the fine sand is silica grade sand. Preferably the fine grade sand is silica sand which is dyed or colored green to blend with the color of the pile yarns forming the pile of the artificial turf as pile fabric.

Figure 2B:
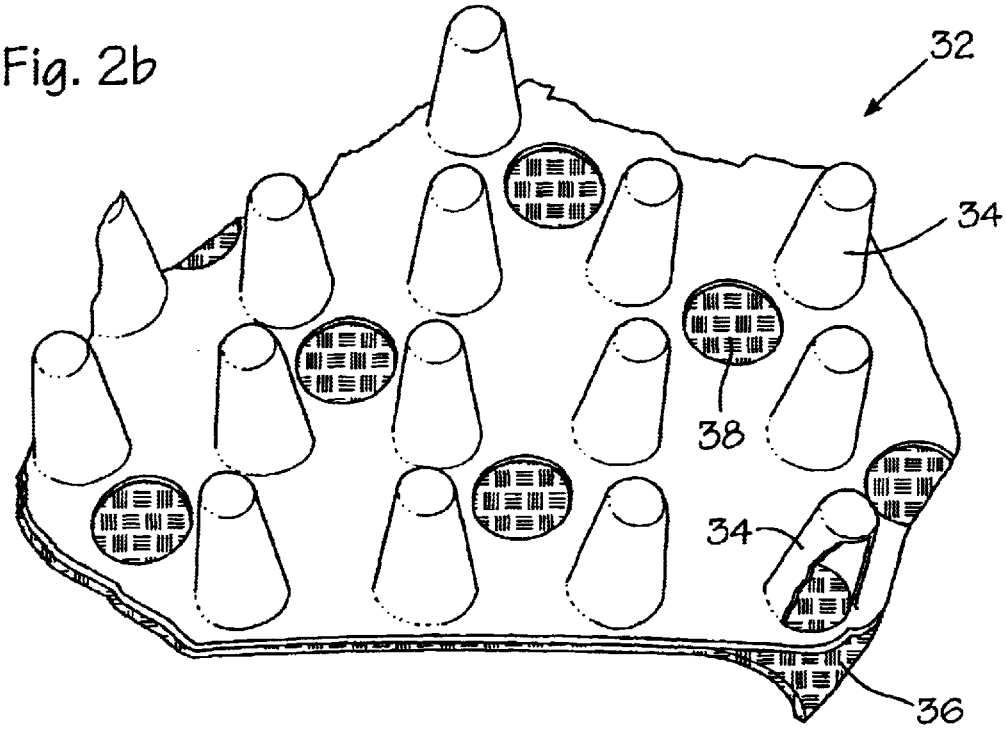
FIG. 2*b* is a sectional perspective view of a PYRACELL strip.

PYRACELL sheets 32 are formed to a width of about 3' to 5' and in indeterminate lengths. Each PYRACELL sheet comprises a synthetic sheet in which a plurality of conically shaped cells 34 are formed to extend upwardly from its upper surface. Each cell 34 is closed at its top and extends upwardly from the synthetic to a height of about 1". Each cell has a diameter at its top of about ⅜" and progresses downwardly to a diameter of about ⅞". Drain holes 36 are formed in selected areas between cells 34. A non-woven porous fiber matt 38 is secured over the lower surface of the synthetic sheet closing the open bottom of each PYRACELL 32 as clearly shown in FIG. 2*b*. Preferably the synthetic material forming the PYRACELL sheets is polystyrene and that forming the fiber matt is polypropylene.

Figure 4:
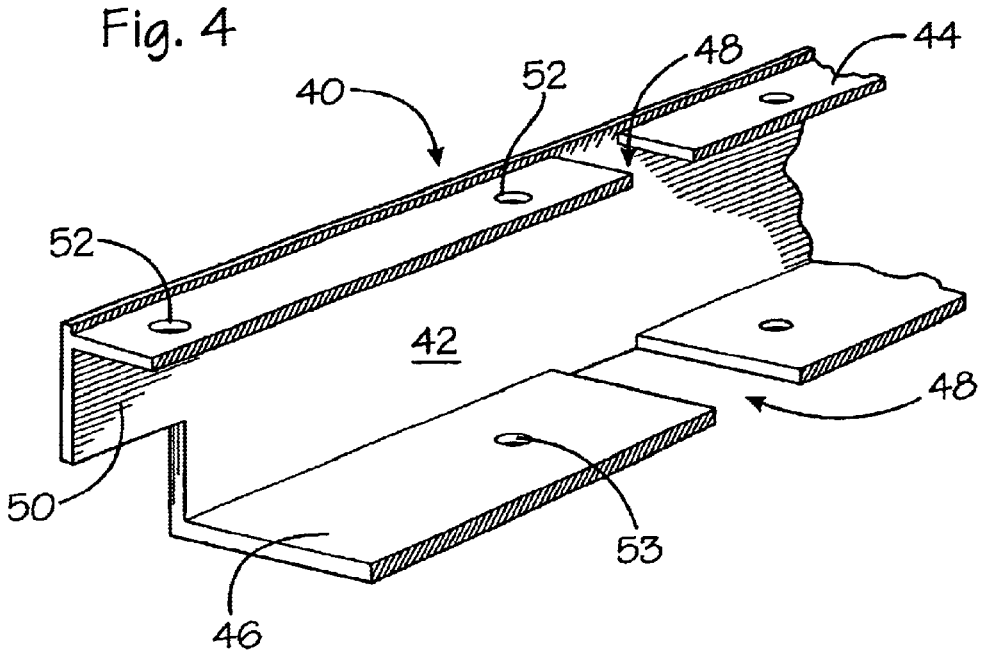
FIG. 4 is a perspective sectional side view of an edging strip piece.

Edging strips 40, as seen in FIG. 4, 4*a*, from the border 12. Each edging strip is preferably formed flexible plastic to be about 2'in length. Each strip includes vertical panel 42 which is about 1" high. Each panel has formed on a first side a plurality of upper shelves 44 vertically arranged over lower shelves 46. The upper and lower shelves are about 5" in width, extend along parallel planes and are separated by about ½" gap. Gaps 48 form flex points along edging strips 40 allowing them to be bent to conform with the shape of border 12.

Upper and lower shelves 44/46, which are spaced vertically by about ⅞" are formed with holes 52, 53 which are vertically aligned. Holes 52, 53 are adapted to receive elongated securing members 54 which function to secure edging pieces in the desired configuration. Securing members 54 are preferably about 6" in length.

Figure 4A:
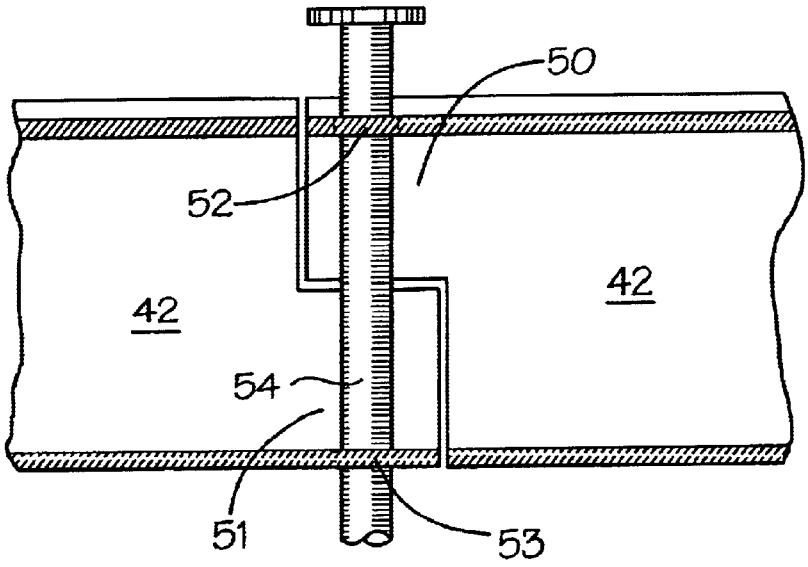
FIG. 4*a* is a sectional side view of a connected joint of two edging strip pieces.

Edging strips 40 at opposite ends are shaped with an upper and lower projection 50, 51. Upper projection 50 contains a portion of upper shelf 44 to include a hole 52 while lower projection 51 contains a portion of lower shelf 46 and hole 53. When adjacent strips 40 are brought together projections 50, 51 overlap with holes 52, 53 aligned allowing an elongated securing member 54 to be passed through the holes forming a pivotal connection and securing the pivot point as shown in FIG. 4*a*.

Figure 2C:
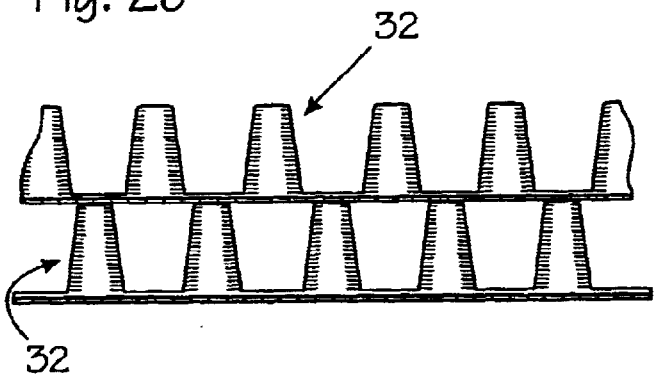
FIG. 2*c* is a sectional side view of stacked PYRACELL strips.
Figure 2D:
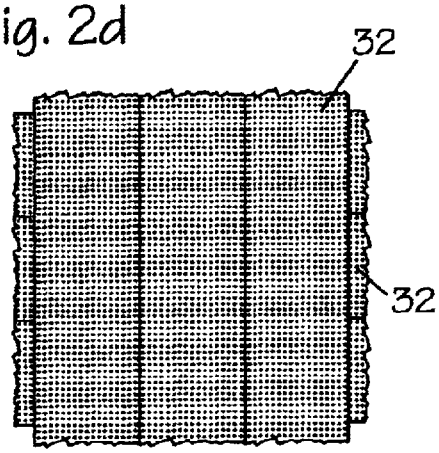
FIG. 2*d* is a sectional top view of stacked PYRACELL strips.
Figure 3:
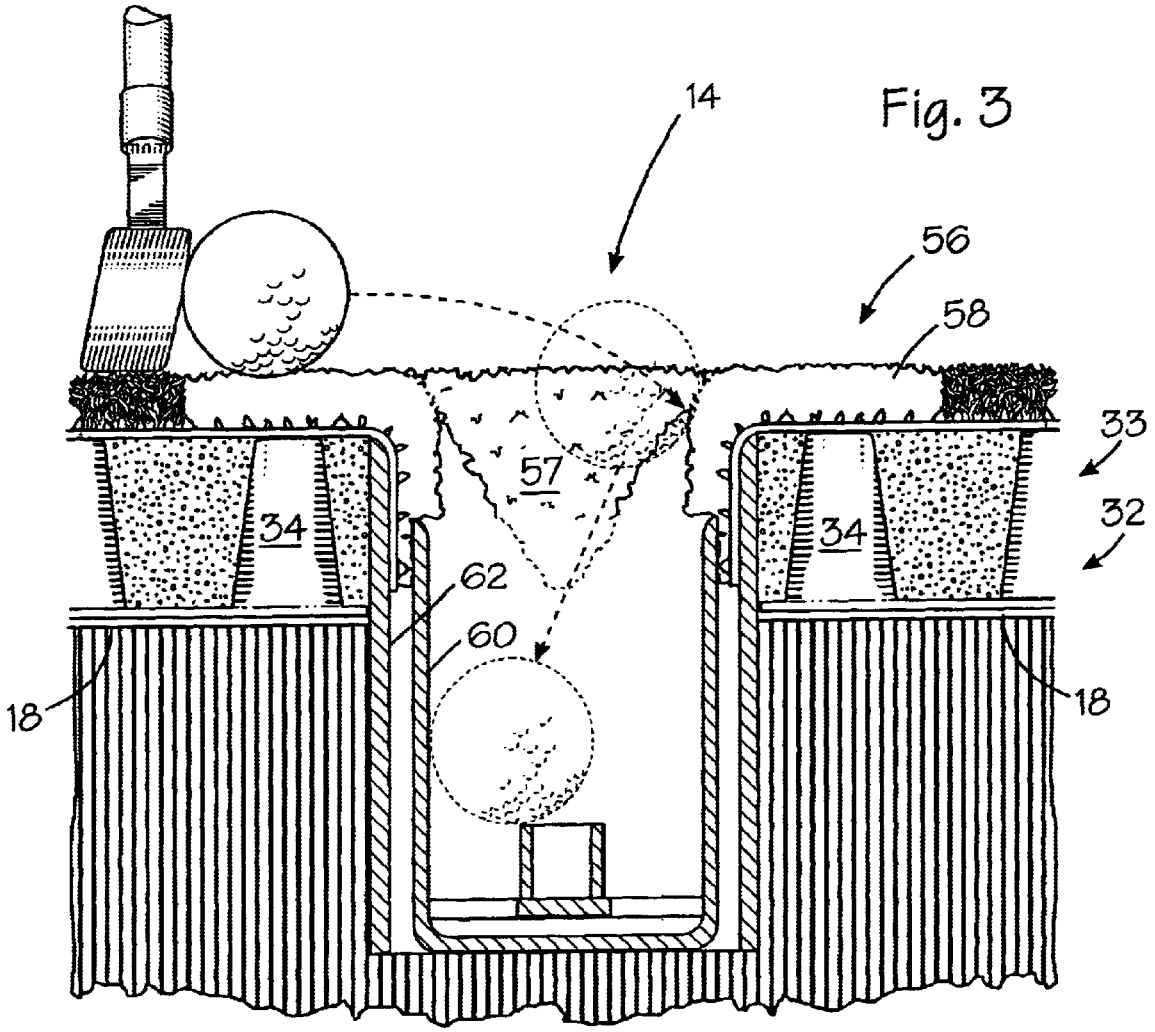
FIG. 3 is a side sectional view of the portion of the putting green of FIG. 1 through the golf cup.

Putting surface 11 as best shown in FIGS. 2 and 3, is formed of artificial turf which consist of a pile fabric 56 which includes pile tufts or yarns 58 formed to a height of between ¾" to 1½". Pile tufts 58 are secured with a porous backing fabric 59 in known manner. Preferably the pile yarns are dyed green.

Fine sand 22 is applied to the putting surface to fill the spaces about the pile yarns. Sand 22 forms a layer which comes to between ⅛" and 3/16" of the tips of the pile yarns. By varying the depth of the fine sand the resistance to ball roll can be controlled as desired. Because of the fineness of the sand, the ball rolls smoothly.

Turning now to FIGS. 1–3, base 18, which is formed to generally the size of the selected putting green configuration or area, such as the exemplary one shown in FIG. 1. Edging strips 40 are positioned in interconnected condition, arranged and secured to outline the selected configuration. Hole 14 is cut in a selected area of base 18 and golf cup retaining tube 62 is positioned therein.

A PYRACELL layer or intermediate layer 33, which comprises a plurality of PYRACELL strips 32 laid side by side to cover the selected base surface. The area about and between each cell 34 is filled with course sand 22 up to at least the tops of the cells forming a smooth surface.

Golf cup retaining tube 22 extends through the PYRACELL layer up to substantially even with the tops of the cells 34 as shown in FIG. 3. Also, as shown in FIG. 2, PYRACELL strips 32 extend toward border 12 to a position where cells 34 engage with or extend under upper shelves 44.

Artificial turf or pile fabric 56 is positioned over the intermediate layer or the PYRACELL layer over the golf cup retaining tube and over edging strips 40 forming border 12. A strip of between 3" to 6" of pile fabric 56 extends beyond edging strips 40. These strips or portions of pile fabric 56 are passed over edging strips 40, down the outer side of panel 42 and then outward away from border 12. Sod and/or fill are applied over and against pile fabric 56 outside border 12 holding it firmly in position.

Over hole 14, slits are cut in pile fabric 56 forming flaps 57 which extend down into golf cup retaining tube 62 as shown in FIG. 3. Golf cup 60 is inserted into retaining tube 62 locating flaps 57 between the inner surface of the golf cup retaining tube and the outer surface of the golf cup which surfaces act to grip and hold the pile fabric in position.

As shown in FIGS. 2*c* and 2*d* PYRACELL sheets 32 may be laid in two layers. In the case illustrated, the lower layer is positioned over base 18 in a plurality of side by side rows and the sand is applied as earlier described. The upper layer is then applied over the lower layer in a side by side arrangement which is perpendicular to the strip rows of the lower layer. Sand is applied to the upper layer as earlier described.

In this second arrangement edging strips 40 forming border 12 may be formed at a greater height. The pile fabric strip extending over edge 12 is lengthened to retain the intermediate layer in position.

While the preferred putting green embodiment of the invention has been described using specific terms, such description is for illustrative purposes only, and it is to be understood.

What is claimed is:

1. An artificial putting green of a defined area having improved stability and feel comprising:

a base;

an intermediate layer positioned over said base;

said intermediate layer comprising a PYRACELL layer covering said base;

said PYRACELL layer including a synthetic sheet formed with a plurality of raised conically shaped hollow cells arranged over its upper surface in equally spaced positions and a plurality of drainage holes formed in between certain of said cells;

a non-woven porous web secured to a lower surface of said sheet, said web covering open ends of said cells and providing drainage through said holes;

coarse sand covering said sheet at least substantially up to top surfaces of said cells;

an artificial putting surface supported by said intermediate layer;

said artificial putting surface comprising a pile fabric with pile in the range of ¼" to ¾" in height with fine sand filling areas between and about said pile; wherein, said putting green provides a surface with adequate resilience which compresses efficiently when accepting a golf shot, and returns to its original position presenting a smooth uniform surface providing adequate feel.

2. The artificial putting green of claim 1 wherein said cells are arranged along X and Y axes in parallel rows with adjacent of said cells being spaced by about 1–¼".

3. The artificial putting green of claim 2 wherein said cells decrease in diameter by about ½" from bottom and top.

4. The artificial putting green of claim 4 wherein said coarse sand is mortar grade sand.

5. The artificial putting green of claim 4 wherein said coarse sand fills said area between said cells to a height substantially equal the height of said top surfaces.

6. The artificial putting green of claim 1 wherein an edging encircles said defined area.

7. The artificial putting green of claim 6 wherein said edging is secured with said base at spaced intervals about said area.

8. The artificial putting green of claim 6 wherein said edging includes a plurality of pieces each having plurality of upper shelves and lower shelves, said upper shelves being spaced above said lower shelves by about 1" and being parallel therewith.

9. The artificial putting green of claim 8 wherein said pile fabric extends over said upper shelves, downwardly adjacent an outer surface of said edging pieces and outwardly from a lower edge of said edging pieces.

10. The artificial putting green of claim 8 wherein longitudinal spaces between said shelves form flex areas allowing said edging pieces to be bent into desired shapes conforming with said defined area.

11. An artificial putting green of defined area having improved stability and resilience comprising:

a base layer formed of smoothed compacted soil;

an intermediate layer supported by said base, said intermediate layer including a synthetic sheet having raised conically shaped cells formed over an upper surface of said sheet with areas between said cells filled with coarse particles forming said intermediate layer with a flat upper surface;

an upper layer including a putting surface, said upper layer comprising a pile fabric supported on said flat upper surface formed of said cells and said coarse particles, said upper layer including fine sand filling interstices about and between pile forming yarns of said pile fabric; and, a continuous edging encircling said base layer and said intermediate layer with said pile fabric of said upper layer passing over and being secured in position outside of said edging.

12. The artificial putting green of claim 11 wherein said synthetic sheet comprises a plurality of synthetic sheets each of limited width and of indeterminate length laid parallel and side by side to cover said defined area.

13. The artificial putting green of claim 11 wherein said intermediate layer comprises superimposed first and second layers of synthetic sheets, said synthetic sheet of each said layer comprising a plurality of synthetic sheets each of limited width and indeterminate length laid parallel and side by side to cover said defined area.

14. The artificial putting green of claim 13 wherein said plurality of synthetic sheets forming said first layer are laid with their indeterminate length being transverse the indeterminate length of said sheets forming said second layer.

15. An artificial sport playing surface of a defined area having improved stability and feel comprising:

a base;

an intermediate layer positioned over said base;

said intermediate layer comprising a PYRACELL layer covering said base;

said PYRACELL layer including a synthetic sheet formed with a plurality of raised conically shaped hollow cells arranged over its upper surface in equally spaced positions and a plurality of drainage holes formed in between certain of said cells;

a non-woven porous web secured to a lower surface of said sheet, said web covering open ends of said cells and providing drainage through said holes;

coarse sand covering said sheet at least substantially up to top surfaces of said cells;

an artificial playing surface supported by said intermediate layer;

said artificial playing surface comprising a pile fabric with pile in the range of ¼" to ¾" in height with fine sand filling areas between and about said pile; wherein, said sport playing surface provides a surface with adequate resilience which compresses efficiently when contacted, and returns to its original position presenting a smooth uniform surface providing adequate feel.

16. The sport playing surface of claim 15 wherein said cells are arranged along X and Y axes in parallel rows with adjacent of said cells being spaced by about 1–¼".

17. The sport playing surface of claim 16 wherein said cells decrease in diameter by about 2" from bottom and top.

18. The sport playing surface of claim 15 wherein said coarse sand is mortar grade sand.

19. The sport playing surface of claim 18 wherein said coarse sand fills said area between said cells to a height substantially equal the height of said top surfaces.

* * * * *